US010352009B1

(12) United States Patent
Cook

(10) Patent No.: US 10,352,009 B1
(45) Date of Patent: Jul. 16, 2019

(54) ANIMAL FECES COLLECTION ASSEMBLY

(71) Applicant: Lauralee Cook, Rawdon (CA)

(72) Inventor: Lauralee Cook, Rawdon (CA)

( * ) Notice: Subject to any disclaimer, the term of this patent is extended or adjusted under 35 U.S.C. 154(b) by 0 days.

(21) Appl. No.: 16/012,425

(22) Filed: Jun. 19, 2018

(51) Int. Cl.
*E01H 1/12* (2006.01)

(52) U.S. Cl.
CPC ..... *E01H 1/1206* (2013.01); *E01H 2001/128* (2013.01); *E01H 2001/1293* (2013.01)

(58) Field of Classification Search
CPC ..... E01H 1/1206; E01H 2001/122; E01H 2001/1226; E01H 2001/128; E01H 2001/1293
USPC ..... 294/1.4, 214
See application file for complete search history.

(56) References Cited

U.S. PATENT DOCUMENTS 3,879,079 A 4/1975 Nicholas
4,148,513 A * 4/1979 Gagne ..... E01H 1/1206 15/104.8
4,165,895 A 8/1979 Bacoka
4,205,869 A * 6/1980 Mathis ..... E01H 1/1206 15/104.8
6,012,748 A 1/2000 Franks
6,039,369 A * 3/2000 Stahovic ..... E01H 1/1206 15/257.2
6,398,278 B1 * 6/2002 Orr ..... E01H 1/1206 15/104.8
6,795,587 B2 9/2004 Tsou
8,066,311 B2 11/2011 Axelrod
8,544,906 B2 10/2013 Northrop
8,684,429 B1 4/2014 Holub
8,827,334 B2 * 9/2014 Endara ..... E01H 1/1206 15/257.2
9,091,031 B2 7/2015 Naseem
9,139,970 B1 9/2015 Little
9,347,192 B1 5/2016 Smith
2002/0185874 A1 * 12/2002 Arceo ..... E01H 1/1206 294/1.4
2005/0184540 A1 * 8/2005 Graziosi ..... A01K 23/005 294/1.4
2009/0072559 A1 * 3/2009 Wilkerson ..... E01H 1/1206 294/1.4

FOREIGN PATENT DOCUMENTS

GB 2 078 096 * 1/1982
WO WO-2011026175 A1 * 3/2011 ..... E01H 1/1206

* cited by examiner

*Primary Examiner* — Dean J Kramer

(57) ABSTRACT

An animal feces collection assembly for collecting animal feces includes a collection unit that may be positioned on the ground in front of animal feces. A bag is removably positioned on the collection unit for receiving the animal feces. A scooper is provided for urging the animal feces into the collection unit.

6 Claims, 5 Drawing Sheets

ANIMAL FECES COLLECTION ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98

The disclosure and prior art relates to collection devices and more particularly pertains to a new collection device for collecting animal feces.

BRIEF SUMMARY OF THE INVENTION

An embodiment of the disclosure meets the needs presented above by generally comprising a collection unit that may be positioned on the ground in front of animal feces. A bag is removably positioned on the collection unit for receiving the animal feces. A scooper is provided for urging the animal feces into the collection unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
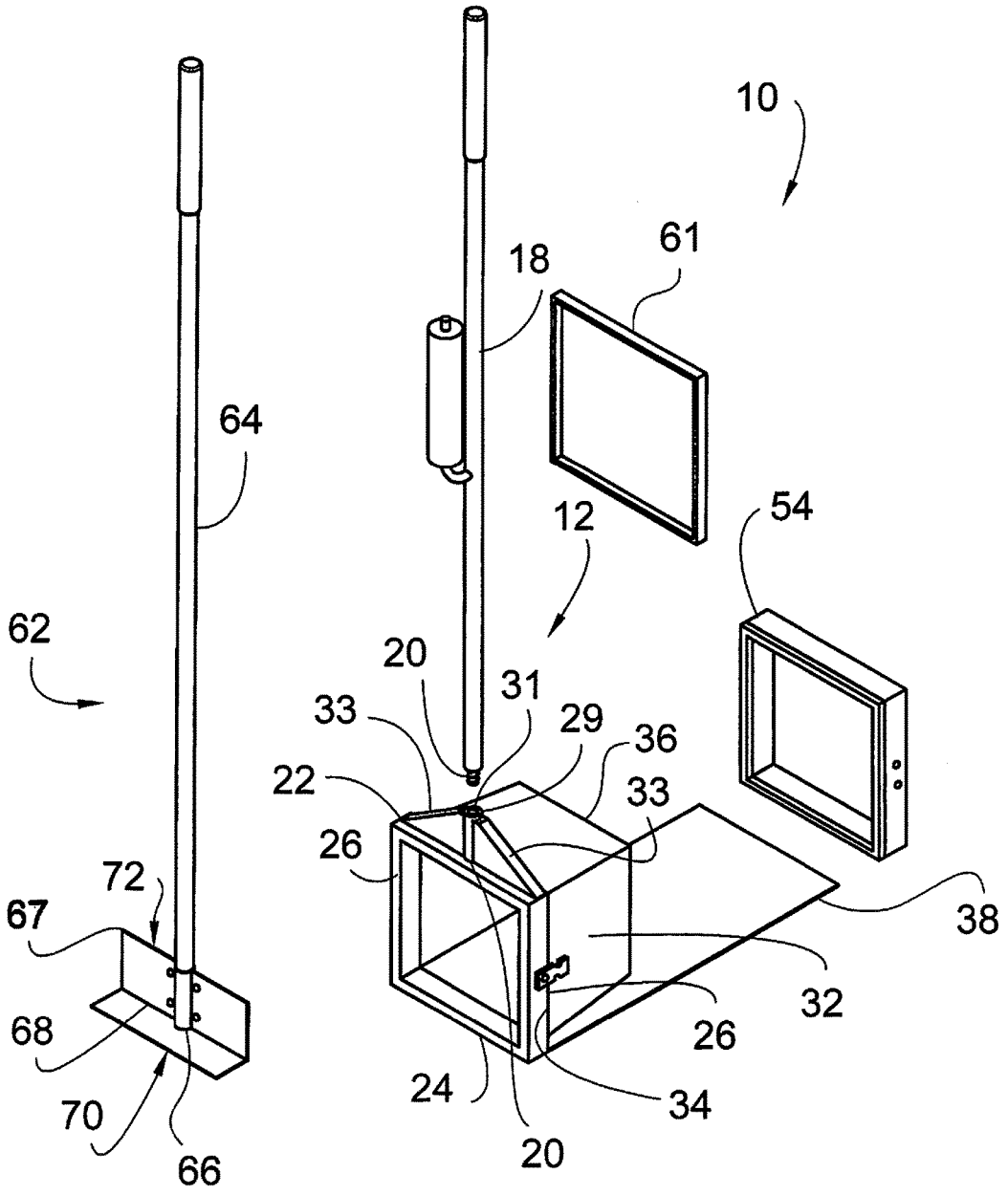
FIG. 1 is a perspective view of an animal feces collection assembly according to an embodiment of the disclosure.
Figure 2:
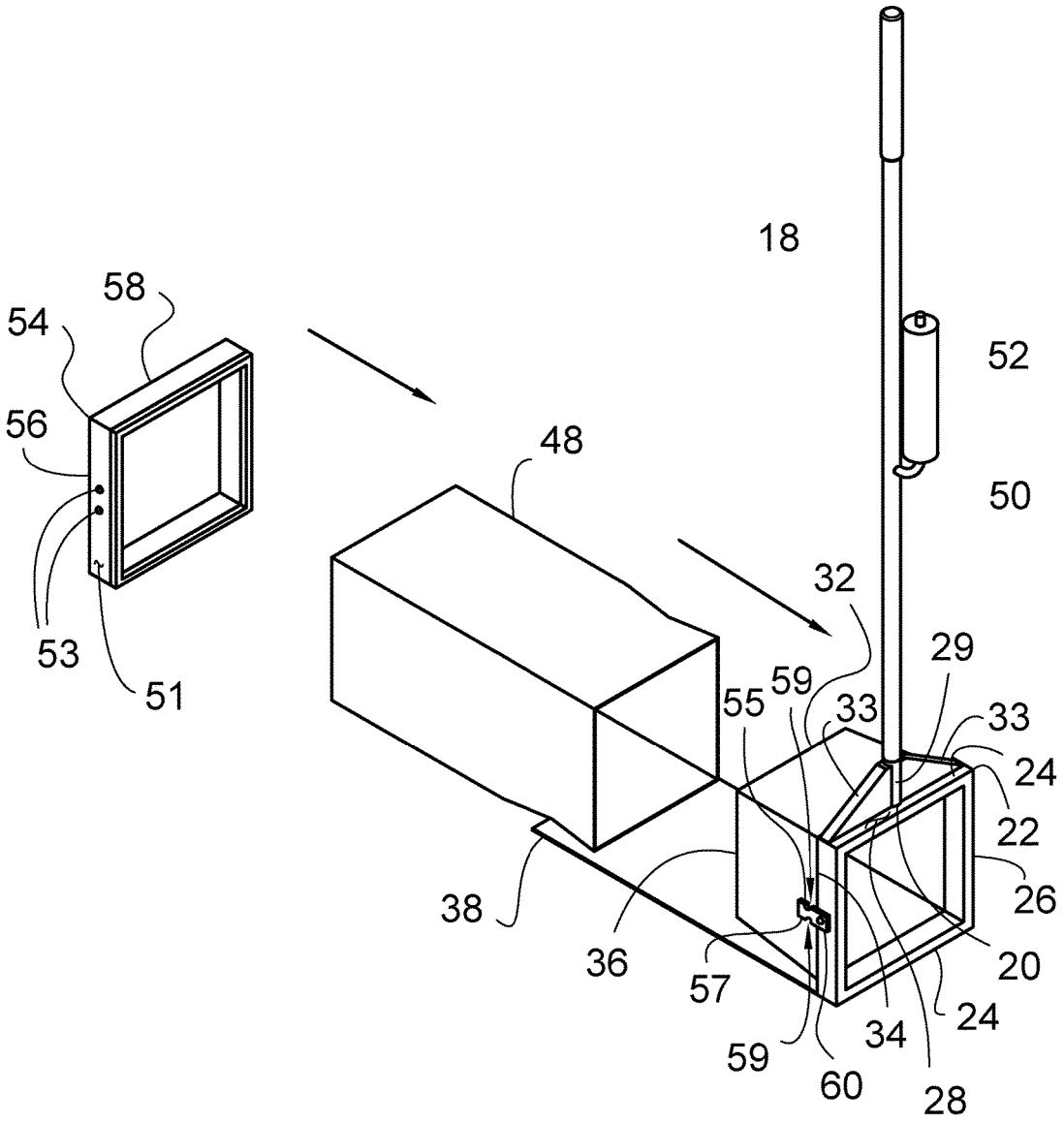
FIG. 2 is an exploded perspective view of an embodiment of the disclosure.
Figure 3:
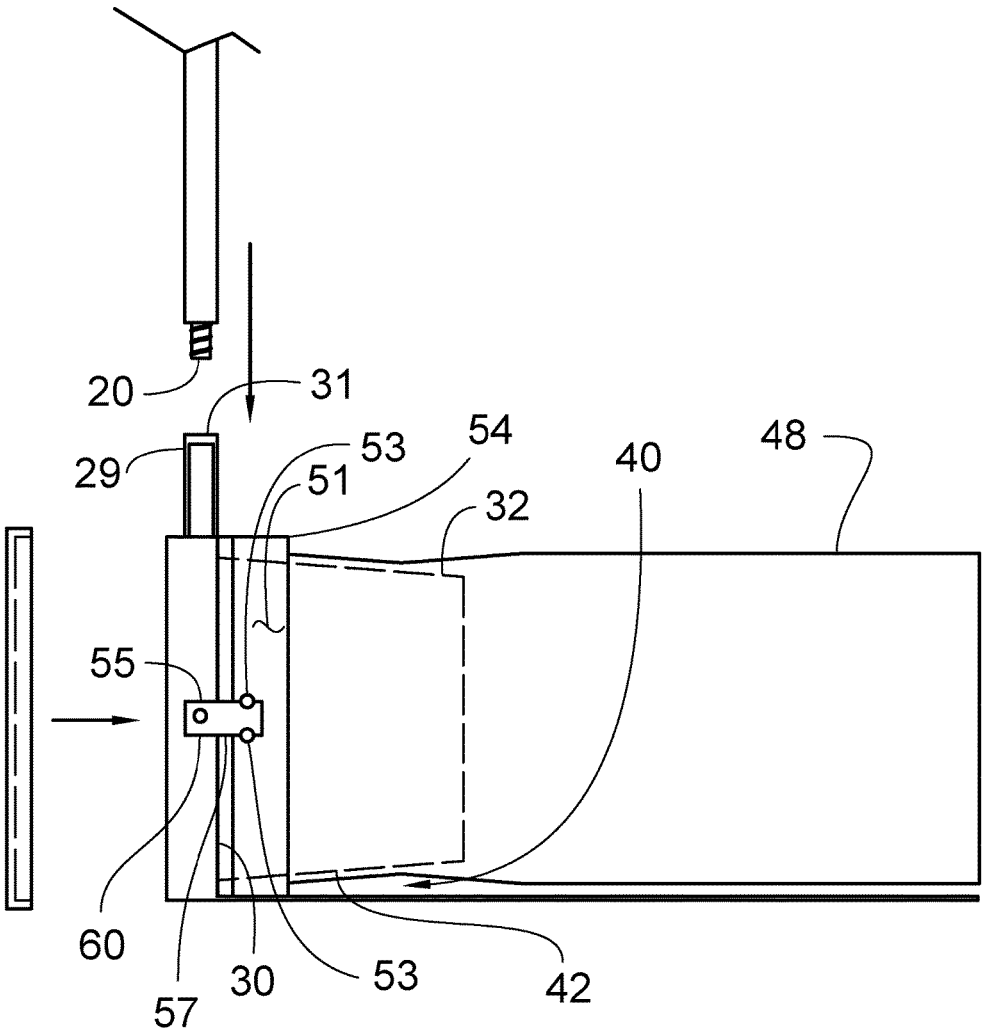
FIG. 3 is a right side view of an embodiment of the disclosure.
Figure 4:
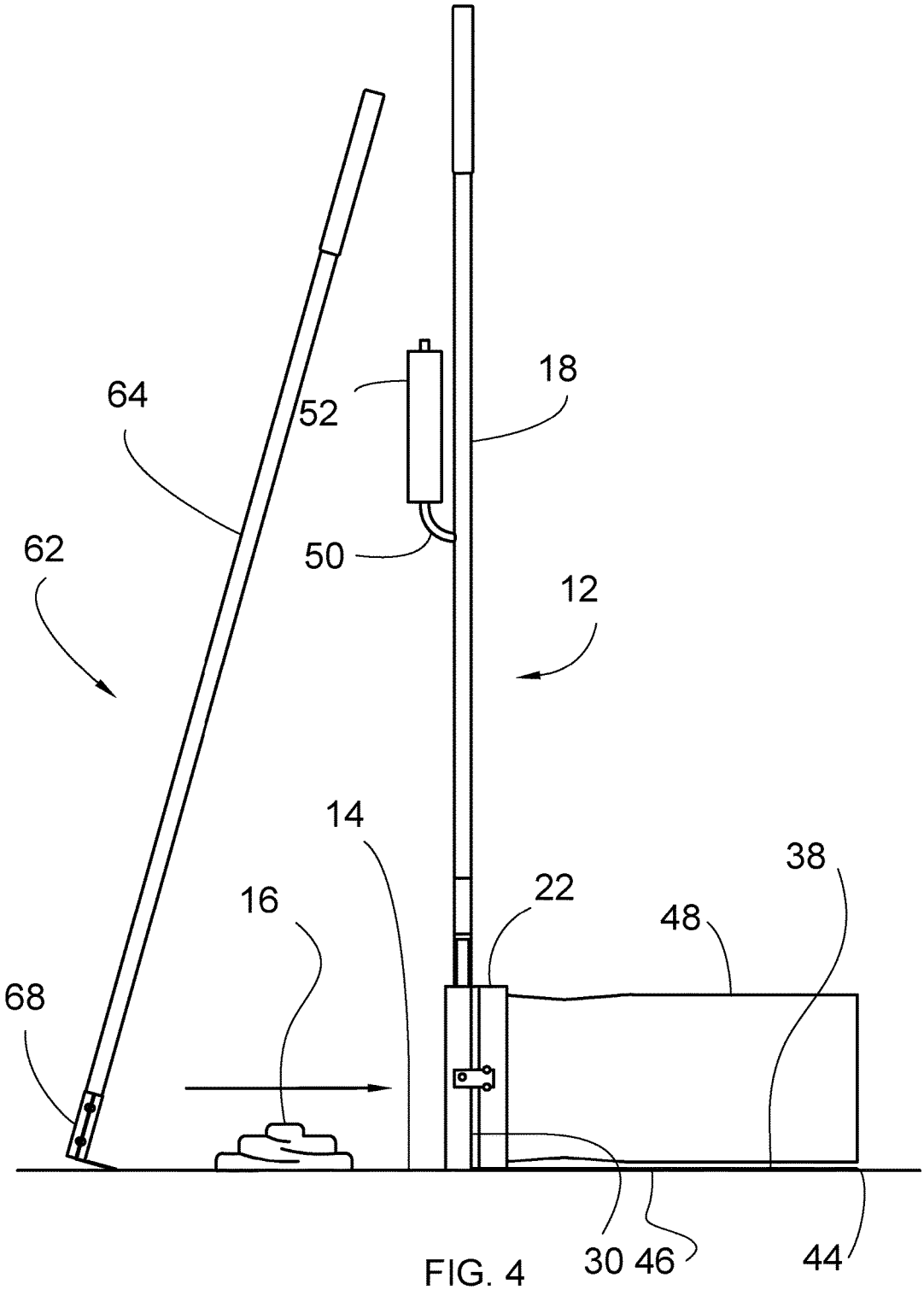
FIG. 4 is a right side view of an embodiment of the disclosure in use.
Figure 5:
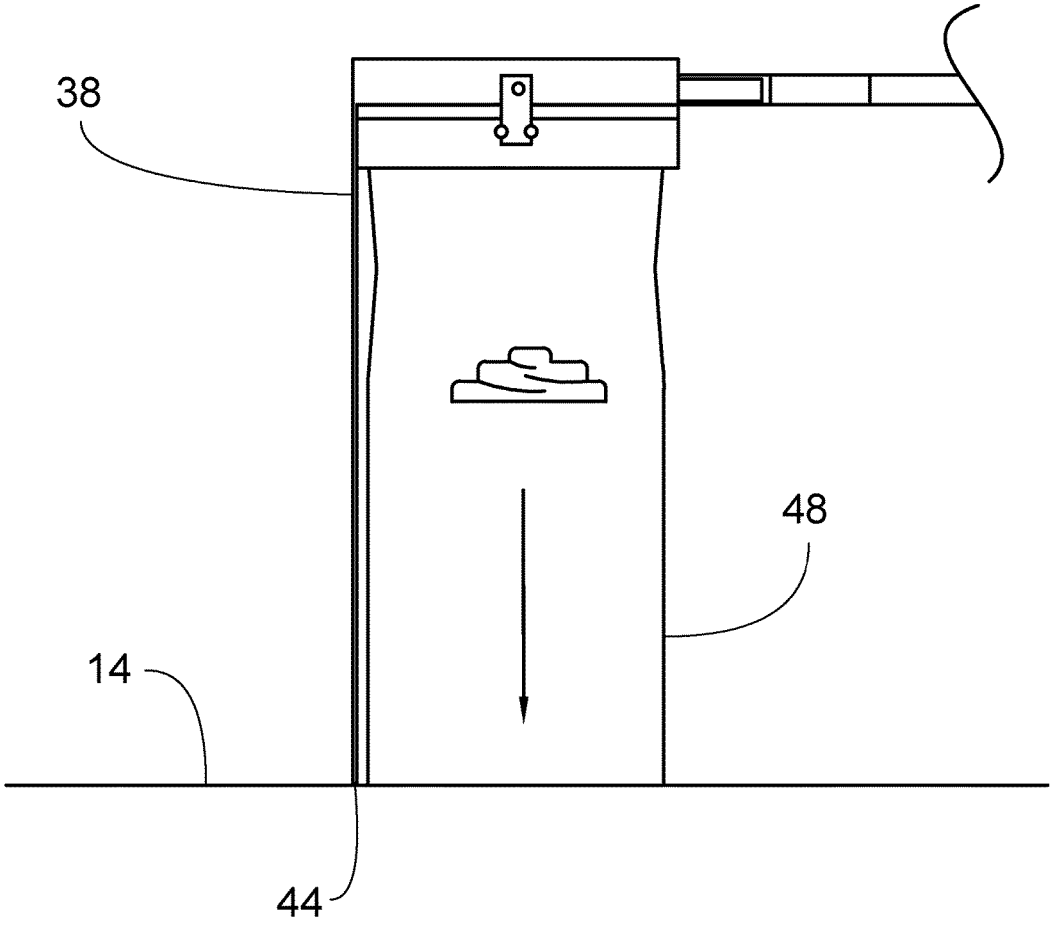
FIG. 5 is right side view of an embodiment of the disclosure in an alternative position.

With reference now to the drawings, and in particular to FIGS. 1 through 5 thereof, a new collection device embodying the principles and concepts of an embodiment of the disclosure and generally designated by the reference numeral 10 will be described.

As best illustrated in FIGS. 1 through 5, the animal feces collection assembly 10 generally comprises a collection unit 12 that may be positioned on the ground 14 in front of animal feces 16. The animal feces 16 may be dog feces or feces from another domesticated animal. The collection unit 12 comprises a shaft 18 that has a first end 20 and the shaft is threaded adjacent to the first end 20. A frame 22 is included and the frame 22 has a pair of first members 24 extending between and being oriented perpendicular to a pair of second members 26. The first members 24 are spaced apart from each other such that the frame 22 has a rectangular shape. The frame 22 has an outwardly facing surface 28 and a rearwardly facing surface 30.

A receiver 29 is coupled to and extends upwardly from the outwardly facing surface 28 of a respective one of the first members 24. The receiver 29 has a distal end 31 with respect to the outwardly facing surface 28 and the distal end 31 is open. The distal end 31 insertably receives the first end 20 of the shaft 18 and the first end 20 threadably engages the receiver 29 to releasably couple the frame 22 to the shaft 18. A pair of gussets 33 extends between the receiver 29 and the outwardly facing surface 28 of the respective first member 24 to vertically stabilize the receiver 29.

The collection unit 12 includes a chute 32 that has a first end 34 and a second end 36, and the chute 32 tapers inwardly between the first end 34 and the second end 36. The first end 34 of the chute 32 is attached to the rearwardly facing surface 30 of the frame 22 such that the chute 32 extends rearwardly away from the frame 22. A tray 38 is attached to and extends away from the rearwardly facing surface 30 of the frame 22. The tray 38 is positioned beneath the chute 32 to define a bag space 40 between the tray 38 and a bottom side 42 of the chute 32. Additionally, the tray 38 has a distal end 44 with respect to the frame 22 and a bottom surface 46. The bottom surface 46 lies on the ground 14 when the collection unit 12 is positioned in front of the animal feces 16. Additionally, the distal end 44 of the tray 38 lies on the ground 14 when the collection unit 12 is positioned in a dumping position having the chute 32 extending toward the ground 14.

A bag 48 is positioned around the chute 32 and engages the frame 22 to collect the animal feces 16 when the animal feces 16 are urged through the frame 22. The bag 48 hangs downwardly from the frame 22 when the collection unit 12 is positioned in the dumping position to deposit the animal feces 16 in the bag 48. The bag 48 may be comprised of a fluid impermeable material such as plastic or the like to contain odors from the animal feces 16. A peg 50 is coupled to and extends upwardly along the shaft 18. A roll of the bags 52 may be positioned on the peg 50 for selectively dispensing the bags 48.

A coupler 54 is provided that has a pair first sides 56 extending between and being oriented perpendicular to a pair of second sides 58. The first sides 56 are spaced apart from each other such that the coupler 54 forms an open rectangle. Additionally, the coupler 54 is positioned around the chute 32 and abuts the rearwardly facing surface 30 of the frame 22 when the bag 48 is positioned on the frame 22 to retain the bag 48 on the frame 22. Each of the first sides 56 has an outwardly facing surface 51 and the outwardly facing surface 51 of each the first sides 56 has a pair of knobs 53 thereon.

A pair of tabs 60 is provided and each of the tabs 60 is coupled to and extends away from the rearwardly facing surface 30 of the frame 22. Each of the tabs has a top edge 55 and a bottom edge 57, and each of the top 55 and bottom 57 edges of each of the tabs 60 has a notch 59 extending toward a center of tab 60. The notch 59 on the top 55 and bottom 57 edges of each of the tabs 60 engages a respective one of the knobs 53 when the coupler 54 is positioned against the frame 22. In this way the tabs 60 retain the coupler 54 on the frame 22 and the coupler 54 retains the bag 48 on the chute 32. A lid 61 is provided and the lid 61 is selectively placed over first end 34 of the chute 32 to close the bag 48 and prevent flies and other insects from entering the bag 48.

A scooper 62 is provided for urging the animal feces 16 into the collection unit 12. The scooper 62 comprises a rod 64 that has a first end 66. The scooper 62 includes a panel 67 that has a bend 68 thereon to form a first section 70 of the panel 67 forming an angle with a second section 72 of the panel 67. The second section 72 of the panel 67 is attached to the rod 64 having the first section 70 of the panel 67 extending away from the first end of the rod 64. The first section 70 of the panel 67 engages the animal feces 16 on the ground 14 to scoop the animal feces 16 into the chute 32.

In use, a bag 48 is removed from the roll of bags 50 and the bag 48 is positioned around the chute 32. The coupler 54 is slid forwardly around the chute 32 to compress the bag 48 against the rearwardly facing surface 30 of the frame 22. The tabs 60 are manipulated to engage the coupler 54 thereby retaining the bag 48 on the chute 32. The shaft 18 is gripped and the tray 38 is positioned on the ground 14 to align the frame 22 with the animal feces 16. The scooper 62 is manipulated to urge the animal feces 16 through the frame 22 and into the chute 32. The collection unit 12 is inverted such that the distal end 44 of the frame 22 rests on the ground 14 thereby suspending the bag 48 from the frame 22. In this way the animal feces 16 falls through the chute 32 and into the bag 48 for collection. At this point the bag 48 is removed from the frame 22, tied off and disposed of.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An animal feces collection assembly being configured for scooping and containing animal feces on the ground, said assembly comprising:

a collection unit being configured to be positioned on the ground in front of animal feces, said collection unit comprising a shaft having a first end and a second end, a frame having a pair first members extending between a pair of second members, said first members being spaced apart from each other such that said frame has a rectangular shape, said frame having an outwardly facing surface and a rearwardly facing surface, said outwardly facing surface corresponding to one of said second members being releasably attached to said second end of said shaft, a chute having a first end and a second end, said chute tapering inwardly between said first end and said second end, said first end being attached to said rearwardly facing surface of said frame such that said chute extends rearwardly away from said frame, and a tray being attached to and extending away from said rearwardly facing surface of said frame, said tray being positioned beneath said chute, said tray having a distal end with respect to said frame and a bottom surface, said bottom surface lying on the ground when said collection unit is positioned in front of the animal feces, said distal end of said tray lying on the ground when said collection unit is positioned in a dumping position having said chute extending toward the ground;

a bag being removably positioned on said collection unit for receiving the animal feces; and a scooper being configured to be manipulated for urging the animal feces into said collection unit.

2. The assembly according to claim 1, wherein said bag is positioned around said chute and engaging said frame wherein said bag is configured to collect the animal feces when said animal feces is urged through said frame, said bag hanging downwardly from said frame when said collection unit is positioned in said dumping position to deposit the animal feces in said bag.

3. The assembly according to claim 2, further comprising a coupler having a pair first sides extending between a pair of second sides, said first sides being spaced apart from each other such that said coupler forms an open rectangle, said coupler being positioned around said chute and abutting said rearwardly facing surface of said frame when said bag is positioned on said frame to retain said bag on said frame.

4. The assembly according to claim 1, wherein said scooper comprises a rod having a first end.

5. The assembly according to claim 4, further comprising a panel having a bend therein to form a first section of said panel forming an angle with a second section of said panel, said second section of said panel being attached to said rod having said first section of said panel extending away from said first end of said rod wherein said first section of said panel is configured to engage the animal feces on the ground.

6. An animal feces collection assembly being configured for scooping and containing animal feces on the ground, said assembly comprising:

a collection unit being configured to be positioned on the ground in front of animal feces, said collection unit comprising:

a shaft having a first end;

a frame having a pair first members extending between a pair of second members, said first members being spaced apart from each other such that said frame has a rectangular shape, said frame having an outwardly facing surface and a rearwardly facing surface, said outwardly facing surface corresponding to one of said second members being releasably attached to said first end of said shaft;

a chute having a first end and a second end, said chute tapering inwardly between said first end and said second end, said first end being attached to said rearwardly facing surface of said frame such that said chute extends rearwardly away from said frame;

a tray being attached to and extending away from said rearwardly facing surface of said frame, said tray being positioned beneath said chute, said tray having a distal end with respect to said frame and a bottom surface, said bottom surface lying on the ground when said collection unit is positioned in front of the animal feces, said distal end of said tray lying on the ground when said collection unit is positioned in a dumping position having said chute extending toward the ground;

a bag being positioned around said chute and engaging said frame wherein said bag is configured to collect the animal feces when said animal feces is urged through said frame, said bag hanging downwardly from said frame when said collection unit is positioned in said dumping position to deposit the animal feces in said bag;

a coupler having a pair first sides extending between a pair of second sides, said first sides being spaced apart from each other such that said coupler forms an open rectangle, said coupler being positioned around said chute and abutting said rearwardly facing surface of said frame when said bag is positioned on said frame to retain said bag on said frame; and a scooper being configured to be manipulated for urging the animal feces into said collection unit, said scooper comprising:

a rod having a first end; and a panel having a bend therein to form a first section of said panel forming an angle with a second section of said panel, said second section of said panel being attached to said rod having said first section of said panel extending away from said first end of said rod wherein said first section of said panel is configured to engage the animal feces on the ground.

* * * * *